United States Patent [19]

Mortensen

[11] Patent Number: 4,909,712

[45] Date of Patent: Mar. 20, 1990

[54] ELECTROMAGNETIC FLUID PUMP HAVING "O" RING SEALS TO FACILITATE DISASSEMBLY

[75] Inventor: Harold R. Mortensen, Elmira, N.Y.

[73] Assignee: Facet Enterprises, Inc., Tulsa, Okla.

[21] Appl. No.: 268,281

[22] Filed: Nov. 7, 1988

[51] Int. Cl.[4] ..... F04B 17/04; F04B 39/14

[52] U.S. Cl. ..... 417/360; 417/417; 310/15

[58] Field of Search ..... 417/360, 416, 417, 418, 417/552, 553, 554; 310/15, 23, 30; 123/497, 499

[56] References Cited

U.S. PATENT DOCUMENTS

| | | | |
|---|---|---|---|
| 2,764,098 | 9/1956 | Dickey et al. | 417/417 |
| 2,765,747 | 10/1956 | Aumick | 417/417 |
| 2,833,221 | 5/1958 | Dickey | 417/422 X |
| 3,381,616 | 5/1968 | Wertheimer et al. | 417/417 |
| 4,122,378 | 10/1978 | Brown | 417/417 X |
| 4,306,842 | 12/1981 | Masaka | 417/417 |
| 4,314,797 | 2/1982 | Gerwin | 417/566 X |
| 4,661,048 | 4/1987 | Masaka et al. | 417/417 X |
| 4,749,343 | 6/1988 | Brown | 417/552 X |
| 4,778,357 | 10/1988 | Arai et al. | 417/417 |
| 4,832,583 | 5/1989 | Brown | 417/417 |

FOREIGN PATENT DOCUMENTS

| | | | |
|---|---|---|---|
| 2755387 | 6/1978 | Fed. Rep. of Germany | 417/417 |
| 55-075579 | 6/1980 | Japan | 417/417 |
| 2124709 | 2/1984 | United Kingdom | 417/417 |

*Primary Examiner*—Donald E. Stout
*Assistant Examiner*—Eugene L. Szczecina
*Attorney, Agent, or Firm*—Remy J. VanOphem

[57] ABSTRACT

An electromagnetic fluid pump having a generally cylindrical housing divided into an inlet chamber, an outlet chamber and an intermediate chamber by a pole member and a separator plate. The pole member is sealingly attached to the wall of the housing and divides the inlet chamber from the intermediate chamber. A first O ring provides a gas tight seal between the pole member and a piston guide which provides a fluid passageway between the inlet chamber and the outlet chamber. The separator plate is sealingly attached to the end of the piston guide adjacent to the outlet chamber and separates the outlet chamber from the intermediate chamber. A second O ring provides a gas tight seal between the internal wall of the housing and a rim portion of the separator plate. An electrical connector having a connector pin provides electrical power to an electronic circuit periodically energizing a solenoid coil to reciprocate a piston disposed in the piston guide. A third O ring provides a gas tight seal between the connector pin and the body of the electrical connector. One-way valve means provide for unidirectional fluid flow from the inlet chamber to the outlet chamber in response to reciprocation of the piston in the piston guide.

18 Claims, 2 Drawing Sheets

ELECTROMAGNETIC FLUID PUMP HAVING "O" RING SEALS TO FACILITATE DISASSEMBLY

BACKGROUND OF THE INVENTION

1. Field of the Invention

The invention is related to the field of electromagnetic fluid pumps and in particular to improvements of the reciprocating piston electromagnetic fluid pumps of the type disclosed by Dickey et al in U.S. Pat. No. 2,764,098.

2. Description of the Prior Art

The reciprocating piston fluid pump disclosed by Dickey et al in U.S. Pat. No. 2,764,098 has found wide acceptance in the commercial market and is extensively used for many different types of applications. The electromagnetic fluid pump has gone through many iterations, but its basic physical structure has remained relatively unchanged. The evolution of this electromagnetic fluid pump is evident from the following U.S. patents which disclose some of the improvements and variations of this pump over the years. U.S. Pat. No. 2,765,747 issued to Aumich; U.S. Pat. No. 2,833,221 issued to Dickey et al; U.S. Pat. No. 3,381,616 issued to Wertheimer et al; U.S. Pat. Nos. 4,080,552, 4,122,378, and 4,343,597 issued to Brown; U.S. Pat. No. 4,086,518 issued to Wilkinson; and U.S. Pat. No. 4,413,950 issued to Wiernicki. This fluid pump has three discrete internal chambers, an input chamber connected to an input port, an outlet chamber connected to an outlet port, and an intermediate chamber housing a solenoid coil and associated electronics. The intermediate chamber is normally back filled with an inert gas to prevent oxidation of electrical contacts and deterioration of the solenoid coil and the associated electrical components. The sealing between the separate chambers and the sealing of the housing itself in all of these different embodiments is accomplished with tin-plated solder joints. It was felt that these solder joints were necessary for the structural integrity of the pump and were less subject to leakage and other fatigue type failures over the life of the pump. Although the solder joints proved to be very effective in maintaining the seals between the three internal chambers of the pump, it was found that the flux used in making these solder joints was having adverse effects on the electronics and also the solder seals made it uneconomical to disassemble the pump for repair or salvage of its parts. The invention is a redesigned pump structure which eliminates selected solder joints and permits the pump to be disassembled for repair or salvage.

SUMMARY OF THE PRESENT INVENTION

The invention is an electromagnetic fluid pump having a cylindrical housing. The cylindrical housing has an inlet port and an outlet port disposed adjacent to the opposite ends thereof. A cylindrical piston guide member is disposed in the housing and defines a fluid path through the housing between the inlet and outlet ports. A magnetic permeable piston is disposed in the piston guide and is free to reciprocate therein. The pump also includes valve means for providing a unidirectional fluid flow through the piston guide member from the inlet to the outlet port in response to the reciprocation of the piston. Biasing means provided resiliently bias the piston toward the end of the piston guide member adjacent to the outlet port. An annular first pole member supports the piston guide member in the housing at a first location. An annular second pole member sealingly attached to the internal wall of the housing also supports the piston guide member at a second location. The second pole member has an axial bore through which the piston guide member passes and a first O ring groove provided in the axial bore. A first O ring is disposed in the first O ring groove and provides a gas tight seal between the second pole member and the piston guide member. A solenoid coil circumscribes the piston guide member between the first and second pole members. A separator plate is sealingly attached to the end of the piston guide member adjacent to the outlet port. The separator plate has an axial aperture providing a fluid flow path between the interior of the piston guide member and the outlet port. The separator plate has a radial flange portion and an integral cylindrical rim portion slidably engaging the internal wall of the housing. The separator plate, in cooperation with the second pole member, forms an intermediate chamber. A second O ring provides a gas tight seal between the cylindrical rim portion of the separator plate and the internal walls of the housing. A cylindrical retainer supported from the end of the housing adjacent to the outlet port retains the radial flange portion of the separator plate in a predetermined position. A first cap encloses the end of the housing adjacent to the outlet port and locks the cylindrical retainer to the end of the housing. The first cap cooperates with the separator plate to form a fluid outlet chamber connected to the outlet port. A second cap encloses the end of the housing adjacent to the inlet port. The second cap cooperates with the second pole member to form a fluid inlet chamber connected to the inlet port. An electrical circuit is disposed in the intermediate chamber for periodically energizing the solenoid coil to reciprocate the piston in the piston guide member. Finally, an electrical connector attached to the housing provides electrical power to the electrical circuit and the solenoid coil.

The object of the invention is to provide an electromagnetic fluid pump assembly which may be easily disassembled for repair and/or salvage.

Another object of the invention is to seal the intermediate chamber of the pump from the inlet and outlet chambers using O rings at selected locations to facilitate the disassembly of the pump.

A further object of the invention is to use an O ring seal between the lower pole member and the piston guide member.

Still another object of the invention is to provide an O ring seal between the outlet chamber and the intermediate chamber.

These and other objects of the invention will become more apparent from a reading of the detailed description of the invention in conjunction with the drawings.

DETAILED DESCRIPTION OF THE PREFERRED EMBODIMENT

Figure 1:
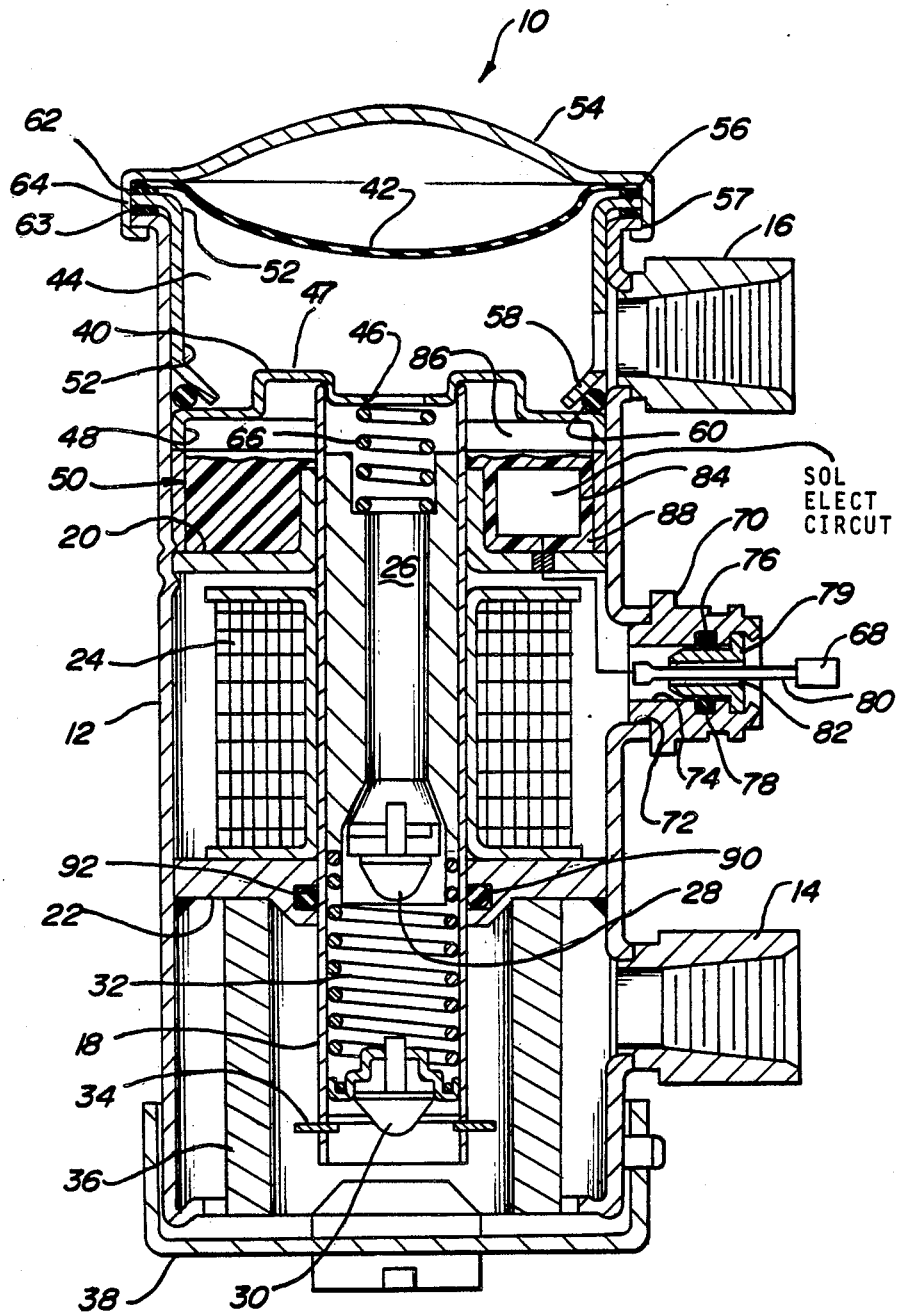
FIG. 1 is a cross-sectional side view of the electromagnetic fluid pump.

Referring to FIG. 1, the numeral 10 indicates an electromagnetic fluid pump having a generally cylindrical housing 12 with a fluid inlet port 14 and a fluid outlet port 16. Contained within the housing 12 is a nonmagnetic cylindrical piston guide member 18 which is supported within the housing 12 between the inlet port 14 and the outlet port 16 by a pair of annular pole members 20 and 22. The pole member 20 is secured to the housing 12 by staking the housing as shown in three different places. The pole member 22 has an O ring groove 90 which contains a first O ring 92 providing a fluid tight seal between the pole member 22 and the piston guide member 18. The outer edge of the pole member 22 is brazed to the internal wall of the housing 12 to form a fluid tight seal isolating the inlet fluid chamber from the rest of the housing.

Disposed intermediate the annular pole members 20 and 22 is a solenoid coil 24 which circumscribes the piston guide member 18. A hollow magnetic permeable piston 26 is slidably received inside the piston guide member 18 and is free to reciprocate therein. A first one-way valve 28 is disposed at the end of the piston 26 facing the inlet port 14 and a second one-way valve 30 is disposed at the end of the piston guide member 18 adjacent to the inlet port 14. The first and second one-way valves, 28 and 30, respectively, cooperate with each other in a known way to provide a unidirectional fluid flow through the pump from the inlet port 14 to the outlet port 16 in response to reciprocation of the piston 26 in the piston guide member 18. A return spring 32 compressively disposed between the piston 26 and the second one-way valve 30 resiliently biases the piston toward the end of the piston guide member adjacent to the outlet port 16. A lock ring 34 restrains the displacement of the second one-way valve 30 in a direction away from the piston member 26. A cylindrical filter member 36 may be disposed between the cylindrical guide member 18 and the internal walls of the housing 12 at the end of the housing adjacent to the inlet port 14. The filter member 36 removes the particulates in the fluids being pumped which may otherwise foul the operation of the pump.

A removable cap 38 encloses the open end of the cylindrical housing 12 adjacent to the inlet port 14 which permits periodic changing of the filter member 36.

A separator plate 40 is attached to the end of the piston guide member 18 adjacent to the outlet port 16 which, in combination with a flexible diaphragm 42, forms an outlet chamber 44. The separator plate is solder sealed to the end of the piston guide member 18 adjacent to the outlet port 16 and has an axial aperture 46 connecting the interior of the piston guide member 18 with the outlet chamber 44. The separator plate 40 has a radially extending flange portion 47 and a cylindrical rim portion 48 which slidably engages the internal wall of the cylindrical housing 12. A first cylindrical spacer 50 disposed between the annular pole member 20 and the rim portion 48 of the separator plate positions the radial flange portion 47 of the separator plate 40 and the piston guide member 18 with respect to the solenoid coil 24. A second cylindrical spacer 52 is disposed between a domed cap 54 and the separator plate 40. The second cylindrical spacer 50 has an outwardly extending flange 56 which mates with a like flange 57 provided at the outlet end of the housing 12 and an inwardly extending flange 58 adjacent to the separator plate 40. The inwardly extending flange 58 forms an acute angle with respect to the internal walls of the cylindrical housing 12 and in combination with the internal walls of the housing 12 and the separator plate 40 sealingly retains an O ring 60 about the outer edge of the separator plate 40. The O ring 60 seals the gap between the internal walls of the housing 12 and the rim of the separator plate 40 fluidically separating the outlet chamber 44 form the remaining internal portion of the housing 12.

A first annular seal ring 62 is disposed between the outwardly extending flange 56 of the second cylindrical spacer 52 and the flexible diaphragm 42 and a second annular seal ring 63 is disposed between the outwardly extending flange 56 and the outwardly extending flange 57 of the housing 12 to seal the upper portion of the outlet chamber 44. The peripheral edge 64 of the domed cap 54 is spun over, as shown, to lock the flexible diaphragm 42 and the second cylindrical spacer 52 to the end of the housing 12.

A bumper spring 66 is disposed between the piston 26 and the separator plate 40 and cushions the end of the pumping stroke of the piston 26 during operation of the pump. Electrical power input to the electromagnetic pump is received through an electrical connector 68 having a connector body 70 sealingly received in an aperture 72 provided through the side wall of the housing 12. The connector body 70 has an axial bore 74 passing therethrough and an annular O ring groove 76 provided in the surface of the axial bore 74. A connector pin 80 having a circumscribing insulator layer, such as an elongated ceramic layer 82, is received in a connector housing 79. The connector housing 79 is received in the axial bore 74 and staked in place as shown. An O ring 78 disposed in the O ring groove 76 sealingly engages the connector housing 79 to form a gas tight seal between the connector housing 79 and the connector body 70. The internal end of the connector pin 80 is connected to a solenoid (SOL) electrical circuit 84 shown in block form. The solenoid electrical circuit 84 periodically energizes the solenoid coil 24 to generate a magnetic field displacing the piston towards the end of the piston guide member adjacent to the inlet port. The solenoid electrical circuit 84 may be a blocking oscillator as taught by Brown in U.S. Pat. No. 4,086,518 or may be a switching circuit responsive to mechanical or magnetic sensors (not shown) detecting the position of the piston 36 or any other type of circuit known in the art for periodically energizing the solenoid coil 24 to reciprocate the piston 26. The type of circuit used to periodically energize the solenoid coil 24 is immaterial to the invention. The solenoid electrical circuit 84 is normally potted in an intermediate chamber 86 between the annular pole member 20 and the separator plate 40 using a gasoline resistant potting material 88.

Figure 2:
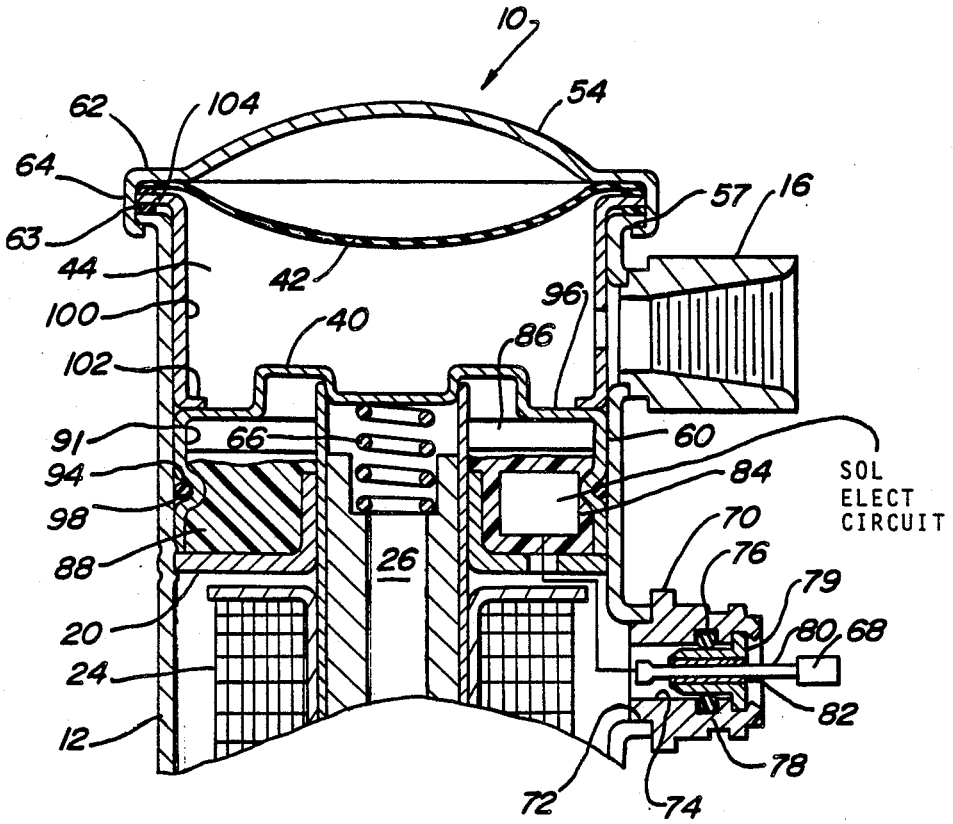
FIG. 2 is a partial cross-sectional side view of an alternate embodiment of the electromagnetic fluid pump.

An alternate embodiment of the electromagnetic fluid pump structure having selected O ring seals to facilitate disassembly is shown in FIG. 2. In this embodiment, the members having identical structure with the corresponding elements of the embodiment shown in FIG. 1 are designated by the same reference numerals. As shown in FIG. 2, the first cylindrical spacer 50 is eliminated and the rim portion 91 of the separator plate 40 is extended to seat on the top surface of the member 20. The rim portion 91 has an annular O ring groove 94 provided intermediate the end seated against the pole member 20 and a radial flange portion 96 of the separator plate 40. An O ring 98 is received in the O ring groove 94 sealing the outlet chamber 44 from the remainder of the housing 12 below the separator plate 40. As in the embodiment shown in FIG. 1, the separator plate 40 is sealingly attached to the piston guide member using solder or any other method known in the art.

The second cylindrical spacer 52 of the embodiment in FIG. 1 is replaced by a cylindrical retainer 100 having the structure shown in FIG. 2. The cylindrical retainer 100 has an inwardly extending flange 102 which abuts the top surface of the separator plate 40 and an outwardly extending flange 104 which corresponds to the outwardly extending flange 56 of the second cylindrical spacer 52. The outwardly extending flange 104 is captivated between the pair of seal rings 62 and 63 when the rim of the domed cap 54 is spun over, as shown, to lock the cylindrical retainer 100 to the top of the housing 12.

In this embodiment, the structure of the electrical connector 68 and the structure of the pole member 22 are the same as shown in FIG. 1.

Although the structure of the electromagnetic pump has been described with reference to a preferred embodiment and an alternate embodiment, it is submitted that a person skilled in the art will be able to devise alternate embodiments providing O ring seals at selected points in the pump structure which will permit the pump to be disassembled for repair or salvage. It is not intended that the invention be limited to the structure illustrated and set forth in the claims appended hereto.

What is claimed is:

1. An electromagnetic pump comprising:

a cylindrical housing having an inlet port and an outlet port;

a cylindrical piston guide member disposed in said housing defining a fluid flow path through said housing between said inlet port and said outlet port;

a magnetically permeable piston disposed in said cylindrical piston guide member, said magnetically permeable piston being free to reciprocate therein;

valve means for providing a unidirectional fluid flow through said cylindrical piston guide member from said inlet port to said outlet port in response to the reciprocation of said magnetically permeable piston;

biasing means for resiliently biasing said magnetically permeable piston towards the end of said cylindrical piston guide member adjacent to said outlet port;

an annular first pole member supporting said cylindrical piston guide member in said housing at a first location;

an annular second pole member sealingly attached to the internal wall of said housing and supporting said cylindrical piston guide member at a second location displaced from said first location, said second pole member having an axial bore through which said cylindrical piston guide member passes and a first O ring groove provided in said axial bore;

a first O ring disposed in said first O ring groove providing a gas tight seal between said second pole member and said cylindrical piston guide member;

a solenoid coil circumscribing said cylindrical piston guide member between said first and second pole members;

a separator plate sealingly attached to the end of said cylindrical piston guide member, said separator plate having an axial aperture providing a fluid flow path between the interior of said cylindrical piston guide member and said outlet port, a radial flange portion and an integral cylindrical rim portion slidably engaging the internal wall of said housing, said separator plate in cooperation with said second pole member forming an intermediate chamber;

a second O ring providing a gas tight seal between said cylindrical rim portion of said separator plate and the internal wall of said housing;

a cylindrical retainer supported from the end of said cylindrical housing adjacent to said outlet port for retaining said radial flange portion of said separator plate in a predetermined position;

a first cap enclosing the end of said housing adjacent to said outlet port, and locking said cylindrical retainer to the end of said housing, said first cap cooperating with said separator plate to form a fluid outlet chamber connected to said outlet port;

a second cap enclosing the end of said housing adjacent to said inlet port, said second cap cooperating with said second pole member to form a fluid inlet chamber connected to said inlet port;

an electrical circuit disposed in said intermediate chamber for periodically energizing said solenoid coil to reciprocate said magnetically permeable piston in said cylindrical piston guide member; and an electrical connector attached to said housing for providing electrical power to said electrical circuit and said solenoid coil.

2. The electromagnetic pump of claim 1, further comprising a cylindrical spacer disposed between said cylindrical rim portion of said separator plate and said first pole member for determining said predetermined position of said radial flange portion of said separator plate.

3. The electromagnetic pump of claim 1, wherein said cylindrical rim portion of said separator plate engages said first pole member and the width of said cylindrical rim portion is selected to locate said radial flange portion of said separator plate at said predetermined position.

4. The electromagnetic pump of claim 3, wherein said cylindrical rim portion has an O ring groove provided therein for retaining said second O ring.

5. The electromagnetic pump of claim 1, wherein said cylindrical retainer has an inwardly directed radial flange disposed at an acute angle relative to the internal wall of said housing, said inwardly directed flange compressively wedging said second O ring against the junction formed between said cylindrical rim portion of said separator plate and said internal wall of said housing to form a gas tight seal between said outlet chamber and said intermediate chamber.

6. The electromagnetic pump of claim 1, wherein said housing has a connector aperture through its wall connected to said intermediate chamber, and further wherein said electrical connector comprises:

a connector body received in said connector aperture and being sealingly attached to said housing, said connector body having an axial bore and a third O ring groove provided in the surface of said axial bore;

a connector housing having an axially disposed connector pin passing therethrough, said connector housing being fixedly disposed in said axial bore; and a third O ring disposed in said O ring groove providing a gas tight seal between said connector body and said connector housing.

7. In an electromagnetic pump of the type having a cylindrical housing, an inlet port provided adjacent to one end of said housing and an outlet port provided adjacent to the other end of said housing, a cylindrical piston guide disposed in said housing defining a fluid path between said inlet port and said outlet port, a magnetically permeable piston slidably disposed in said cylindrical piston guide and free to reciprocate therein, valve means for providing a unidirectional fluid flow through said cylindrical piston guide from said inlet port to said outlet port in response to the reciprocation of said magnetically permeable piston, means for biasing said magnetically permeable piston towards said outlet port, an annular first pole member supporting said cylindrical piston guide within said housing at a first location, a second annular pole member sealingly attached to the internal wall of said housing and supporting said cylindrical piston guide in said housing at a second location, a solenoid coil circumscribing said cylindrical piston guide between said first pole member and said second pole member, an electronic circuit for periodically energizing said solenoid coil to reciprocate said magnetically permeable piston in said cylindrical piston guide, an upper cap enclosing the end of said housing adjacent to said outlet port, a lower cap enclosing the end of said housing adjacent to said inlet port, a separator plate, sealingly attached to the end of said cylindrical piston guide adjacent to said outlet port, and an electrical connector providing electrical power to said electronic circuit, the improvement comprising:

said second pole member having an axial bore through which said cylindrical piston guide passes and an O ring groove provided in the internal surface of said axial bore;

a first O ring disposed in said O ring groove providing a gas tight seal between said second pole member and said cylindrical piston guide;

said separator plate having a radial flange portion and an integral cylindrical rim slidably received in said housing;

a second O ring providing a gas tight seal between the internal wall of said housing and said cylindrical rim of said separator plate; and a cylindrical retainer supported form the end of said housing adjacent to said outlet port for retaining said radial flange portion of said separator plate in a predetermined position.

8. The improvement of claim 7, wherein said electrical connector comprises:

a connector body received in a connector aperture provided in said housing intermediate said separator plate and said second pole member, said connector body having a bore passing therethrough and an O ring groove provided in said bore;

a connector housing having an elongated axial connector pin passing therethrough, said connector housing being fixedly received in said bore; and a third O ring disposed in said O ring groove providing a gas tight seal between said connector body and said connector housing.

9. The improvement of claim 8, further comprising a cylindrical spacer disposed between said cylindrical rim of said separator plate and said first pole member for determining said predetermined position of said radial flange portion of said separator plate.

10. The improvement of claim 8, wherein said cylindrical rim of said separator plate engages said first pole member and the width of said cylindrical rim is selected to locate said radial flange portion of said separator plate at said predetermined position.

11. The improvement of claim 10, wherein said cylindrical rim has an O ring groove intermediate said first pole member and said radial flange portion of said separator plate for retaining said second O ring in contact with the internal surface of said housing.

12. The improvement of claim 9, wherein said cylindrical retainer has an inwardly directed radial flange at the end adjacent to said separator plate, said inwardly directed flange being disposed at an acute angle relative to the internal wall of said housing such as to compressively wedge said second O ring against the junction of said cylindrical rim of said separator plate with the internal wall of said housing to form a gas tight seal.

13. An electromagnetic fluid pump comprising:

an enclosed generally cylindrical housing having an inlet chamber, an outlet chamber and an intermediate chamber, said inlet chamber including an inlet port and said outlet chamber including an outlet port;

a cylindrical piston guide disposed in said housing connecting said inlet chamber with said outlet chamber;

a magnetically permeable piston slidably disposed in said piston guide, said magnetically permeable piston being resiliently biased towards said outlet chamber;

solenoid means for periodically displacing said magnetic permeable piston causing it to reciprocate in said cylindrical piston guide;

valve means for producing a unidirectional fluid flow through said cylindrical piston guide from said inlet chamber to said outlet chamber in response to the reciprocation of said magnetically permeable piston in said cylindrical piston guide;

a first annular member sealingly attached to the wall of said housing separating said inlet chamber from said intermediate chamber, said first annular member circumscribing said cylindrical piston guide;

a first O ring disposed between said first annular member and said cylindrical piston guide to provide a gas tight seal therebetween;

a separator plate sealingly attached to the end of said cylindrical piston guide adjacent to said outlet chamber separating said outlet chamber from said intermediate chamber, said separator plate having a rim portion adjacent to the internal wall of said housing; and a second O ring providing a gas tight seal between said rim portion and said internal wall of said housing.

14. The fluid pump of claim 13 having an electrical connector supplying electrical power to said solenoid means, said electrical connector comprising:

a connector body received in an aperture provided in said housing, said connector body having an axial bore therethrough;

a connector pin received in said axial bore, said connector pin having an insulator coating intermediate its opposite ends; and a third O ring disposed between the internal surface of said axial bore and said insulator coating providing a gas tight seal therebetween.

15. The fluid pump of claim 14, wherein said first annular member has an O ring groove for receiving said first O ring.

16. The fluid pump of claim 14, wherein said separator plate has a cylindrical flange portion adjacent to the internal wall of said housing and wherein said fluid pump further includes a cylindrical retainer member attached to said housing, said cylindrical retainer member having an inwardly extending radial flange wedging said second O ring in the junction area between said cylindrical rim of said separator plate and the internal wall of said housing.

17. The fluid pump of claim 14, wherein said separator plate has a cylindrical flange adjacent to the internal wall of said housing and wherein said cylindrical flange has an annular O ring groove provided therein for retaining said second O ring.

18. The fluid pump of claim 14, wherein said connector body has an annular O ring groove provided in the surface of said axial bore for retaining said third O ring.

* * * * *

UNITED STATES PATENT AND TRADEMARK OFFICE

CERTIFICATE OF CORRECTION

PATENT NO. : 4,909,712

DATED : March 20, 1990

INVENTOR(S) : Harold R. Mortensen

It is certified that error appears in the above-identified patent and that said Letters Patent is hereby corrected as shown below:

Column 4, line 3, delete "form" and insert ---- from ----.

Signed and Sealed this

Ninth Day of July, 1991

*Attest:*

HARRY F. MANBECK, JR.

*Attesting Officer*

*Commissioner of Patents and Trademarks*